US008998631B2

(12) United States Patent
Gorman et al.

(10) Patent No.: US 8,998,631 B2
(45) Date of Patent: Apr. 7, 2015

(54) CONNECTOR SYSTEM

(75) Inventors: Andrew Gorman, Swindon (GB); Neal Wilson, South Wales (GB); Jonathan Mark Eyles, Swindon (GB)

(73) Assignee: Tyco Electronics UK Ltd., Swindon, Wiltshire (GB)

( * ) Notice: Subject to any disclaimer, the term of this patent is extended or adjusted under 35 U.S.C. 154(b) by 90 days.

(21) Appl. No.: 13/878,078

(22) PCT Filed: Oct. 4, 2011

(86) PCT No.: PCT/GB2011/051883
§ 371 (c)(1),
(2), (4) Date: Apr. 5, 2013

(87) PCT Pub. No.: WO2012/046040
PCT Pub. Date: Apr. 12, 2012

(65) Prior Publication Data
US 2013/0196556 A1 Aug. 1, 2013

(30) Foreign Application Priority Data
Oct. 7, 2010 (GB) ..... 1016878.9

(51) Int. Cl.
*H01R 13/62* (2006.01)
*H01R 13/17* (2006.01)
*H01R 13/213* (2006.01)
*H01R 13/625* (2006.01)
*H01R 13/639* (2006.01)

(52) U.S. Cl.
CPC ..... *H01R 13/17* (2013.01); *H01R 13/213* (2013.01); *H01R 13/625* (2013.01); *H01R 13/639* (2013.01)

(58) Field of Classification Search
USPC ..... 439/314, 318, 319, 847
See application file for complete search history.

(56) References Cited

U.S. PATENT DOCUMENTS 3,701,965 A * 10/1972 DuRocher et al. ..... 439/86
(Continued)

FOREIGN PATENT DOCUMENTS

EP 0 277 035 A2 8/1988
GB 876269 8/1961
(Continued)

OTHER PUBLICATIONS

International Preliminary Report on Patentability issued by the International Bureau of WIPO, Geneva, Switzerland, dated Apr. 9, 2013, for related International Application No. PCT/GB2011/051883; 9 pages.
International Search Report and Written Opinion issued by the European Patent Office, dated Jan. 25, 2012, for related International PCT Application No. PCT/GB2011/051883; 16 pages.
(Continued)

*Primary Examiner* — Phuong Dinh
(74) *Attorney, Agent, or Firm* — Faegre Baker Daniels LLP

(57) ABSTRACT

There is disclosed a connector system (500) comprising a contact pin (400) and a socket (200) for receiving the contact pin. The contact pin comprises a first groove (402) extending around the axis (410) of the contact pin; a coiled spring (404) within the first groove; and a set of teeth (406) extending around the axis of the contact pin. The socket (200) comprises a cup portion (202). The cup portion comprises a set of teeth (206) extending around the axis (210) of the cup portion (202) and for engaging with the teeth (406) of the contact pin; and a first contact surface (518) inside the cup portion and extending around the axis (210) of the cup portion for contacting the coiled spring (404) of the contact pin.

17 Claims, 5 Drawing Sheets

(56) References Cited

U.S. PATENT DOCUMENTS

| | | | | |
|---|---|---|---|---|
| 4,349,241 | A * | 9/1982 | Juris et al. | 439/88 |
| 4,519,661 | A | 5/1985 | Brush, Sr. et al. | |
| 5,411,348 | A | 5/1995 | Balsells | |
| 5,435,760 | A | 7/1995 | Miklos | |
| 2004/0137771 | A1 | 7/2004 | Schumacher | |
| 2010/0028076 | A1 | 2/2010 | Balsells | |

FOREIGN PATENT DOCUMENTS

| | | | |
|---|---|---|---|
| GB | 2 075 766 | A | 11/1981 |
| GB | 2 284 510 | A | 6/1995 |
| JP | 8078081 | A | 3/1996 |

OTHER PUBLICATIONS

Search Report issued by the UK Intellectual Property Office, dated Feb. 4, 2011, for Application No. GB1016878.9; 1 page.

* cited by examiner

CONNECTOR SYSTEM

The present invention relates to a connector system comprising a contact pin and a socket for receiving the contact pin.

There are a huge variety of different connector systems known in the art, each having relative strengths and weaknesses for different applications.

Connector systems for aerospace applications typically need to be lightweight and very robust to cope with the harsh environmental conditions present on aircraft. A single aircraft may require a huge number of electrical connections, and so another important consideration is speed and accuracy of installation. Connectors for aerospace applications commonly attempt to minimise the possibility of human error leading to faults during installation.

One such aerospace application is in joining aircraft raceways, the raceways being a selection of extruded aluminium profiles which carry the necessary currents for the aircrafts electrical requirements, including grounding. The raceways typically have to be manufactured in sections, and then bonded together with stringent electrical requirements. A single connection may need to carry up to 100 A of current and present a DC resistance of only 0.25 mOhm.

A known connector system is disclosed in U.S. Patent Application Publication US 2010/028076 A1. The connector system has a connector housing with a bore, and a pin for inserting into the bore to make an electrical connection from the pin to the connector housing. The bore has a groove around its circumference that supports a canted coil spring, and the pin has an annular groove. When the pin is inserted into the bore, the canted coil spring locates into the annular groove of the pin and holds the pin in place.

However, a drawback of the above connector system is that shocks and vibrations may cause the pin to move or vibrate relative to the connector housing. This may have long term negative effects on the integrity of the electrical connection, for example due to fretting corrosion.

It is therefore an aim of the invention to provide an improved connector system.

According to an embodiment of the invention, there is provided a connector system comprising a contact pin and a socket for receiving the contact pin, the contact pin comprising:

a first groove extending around the axis of the contact pin;

a coiled spring within the first groove;

a set of teeth extending around the axis of the contact pin;

wherein the socket comprises a cup portion, the cup portion comprising:

a set of teeth extending around the axis of the cup portion and for engaging with the teeth of the contact pin; and a first contact surface inside the cup portion and extending around the axis of the cup portion for contacting the coiled spring of the contact pin.

The connector system comprises both a coiled spring for transmitting electrical current between the contact pin and the socket, and two sets of teeth for engaging with one another to help limit relative movement of the contact pin and the socket.

Advantageously, the cup portion may comprise radially protruding knobs and the connector system may further comprise a rotor mounted around the contact pin, the rotor comprising apertures and cutaways, the apertures leading into the cutaways. The radially protruding knobs of the cup portion may be arranged to be received in the apertures of the rotor upon insertion of the contact pin into the cup portion, and then the radially protruding knobs may be slid along the cutaways upon rotation of the rotor around the contact pin and the cup portion. The radially protruding knobs and the rotor may help secure the contact pin in the socket and enable a fast connection time.

The coil spring rests in a groove of the contact pin before the contact pin and the socket are connected. Therefore the chances of the coil spring becoming damaged may be reduced whilst the socket is attached to an electrode such as a raceway and awaiting a connector pin.

Furthermore, a ridge may be provided around the axis of the contact pin and a further ridge may be provided inside the rotor. A compressible washer may be fitted between the two ridges for urging the contact pin into the cup portion when the rotor is rotated around the contact pin and the cup portion. The teeth of the contact pin may be formed in the ridge of the contact pin to help reduce the weight of the connector.

The rotor may axially extend over the first groove and the coiled spring of the contact pin, to help shield the coiled spring from any external influences that may cause damage to it before the connection is made.

Advantageously, the contact pin may further comprise a second groove extending around the axis of the contact pin. An O-ring may be fitted within the second groove, and the cup portion may further comprise a second contact surface inside the cup portion. The second contact portion may extend around the axis of the cup portion for contacting the O-ring of the contact pin. The O-ring may form an environmental seal to protect the coiled spring from external debris etc.

Furthermore, the first groove may be located further toward the closed end of the cup portion than the second groove when the contact pin is inserted into the cup portion, so that the coiled spring is sealed between the end of the cup and the O-ring, protecting it from the outside environment.

The socket may comprise a fixing portion for electrically and mechanically connecting the cup portion to an electrode, for example an aircraft raceway. The fixing portion and the cup portion may be integrally formed in one piece for strength and ease of manufacturing.

Embodiments of the invention will now be described with reference to the accompanying drawings, in which.

Figure 2:
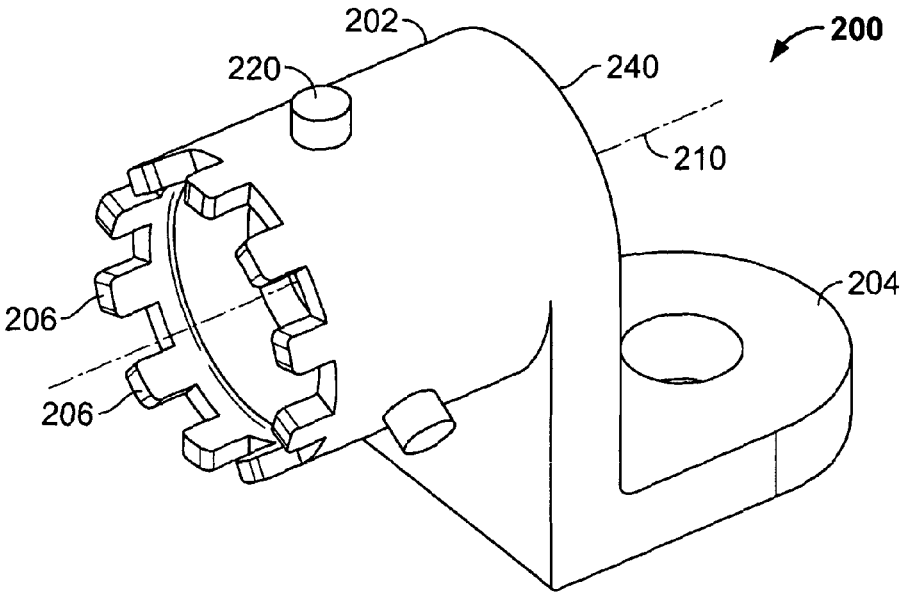
FIG. 2 shows a schematic diagram of a socket forming part of a connector system according to an embodiment of the invention.
Figure 3:
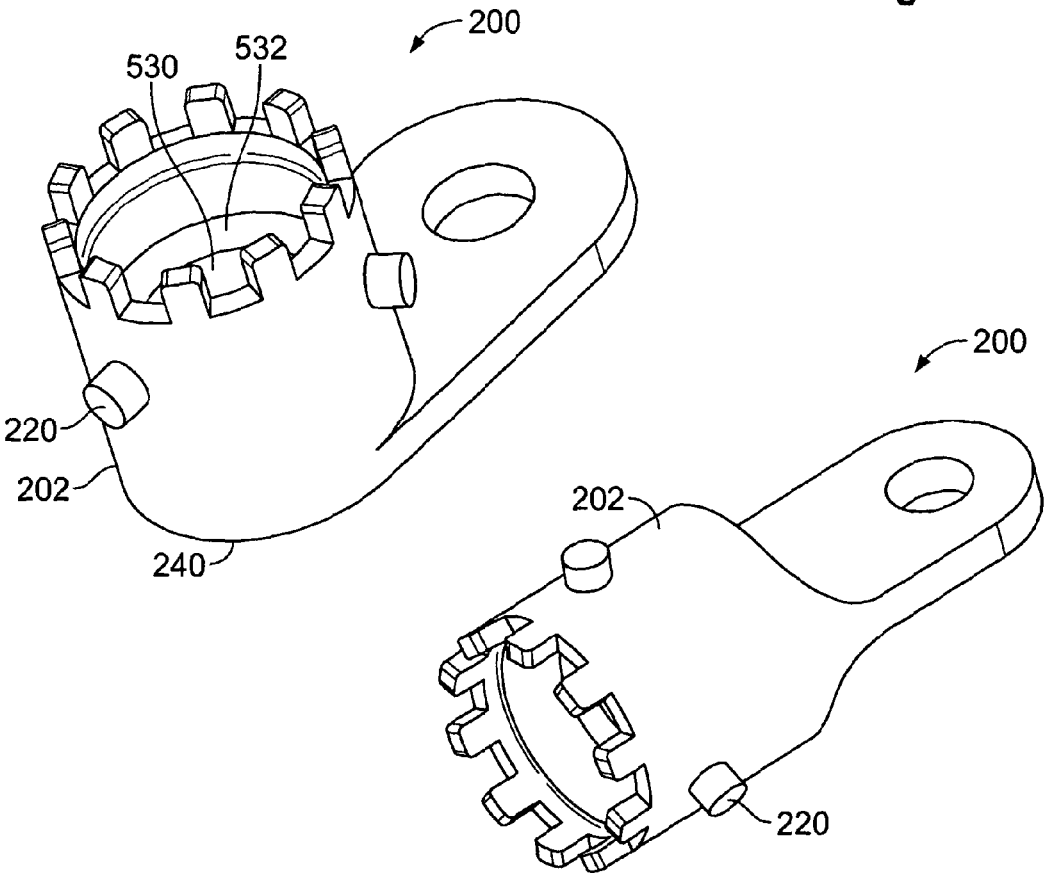
FIG. 3 shows two schematic diagrams of two sockets forming part of connector systems according to further embodiments of the invention.
Figure 4A:
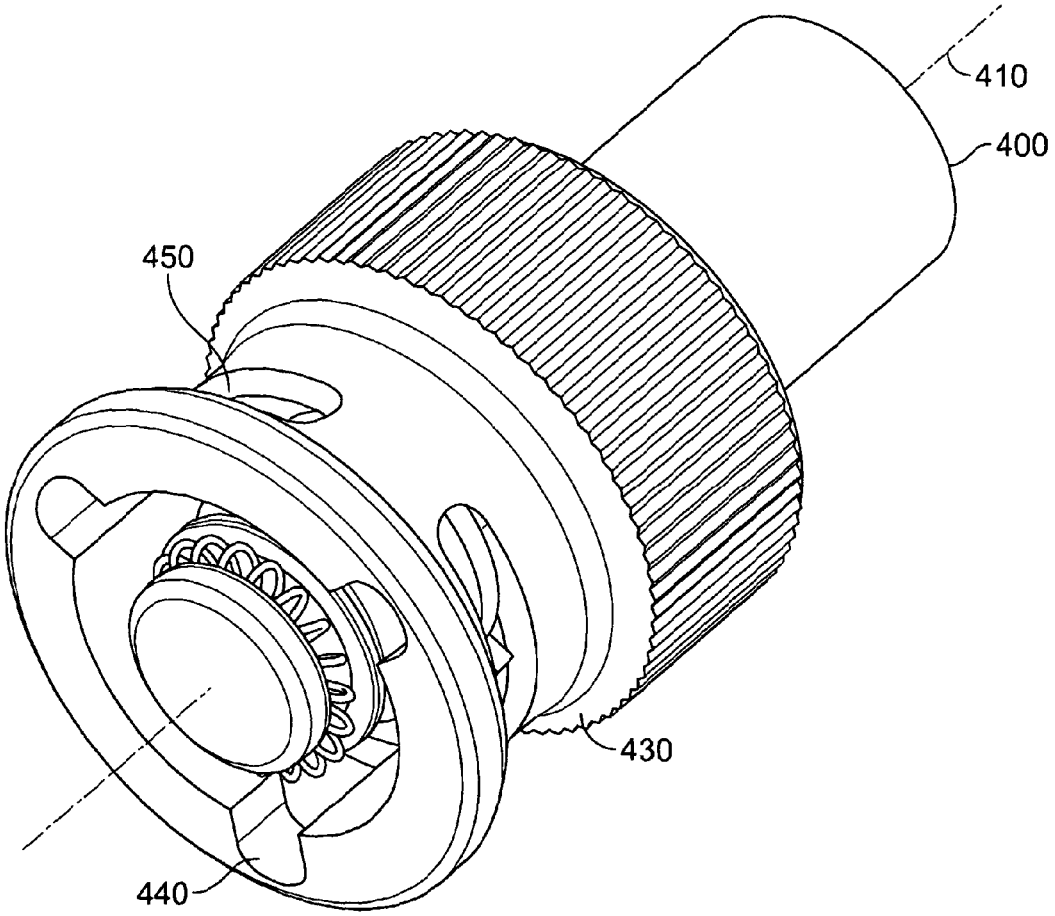
Figure 4B:
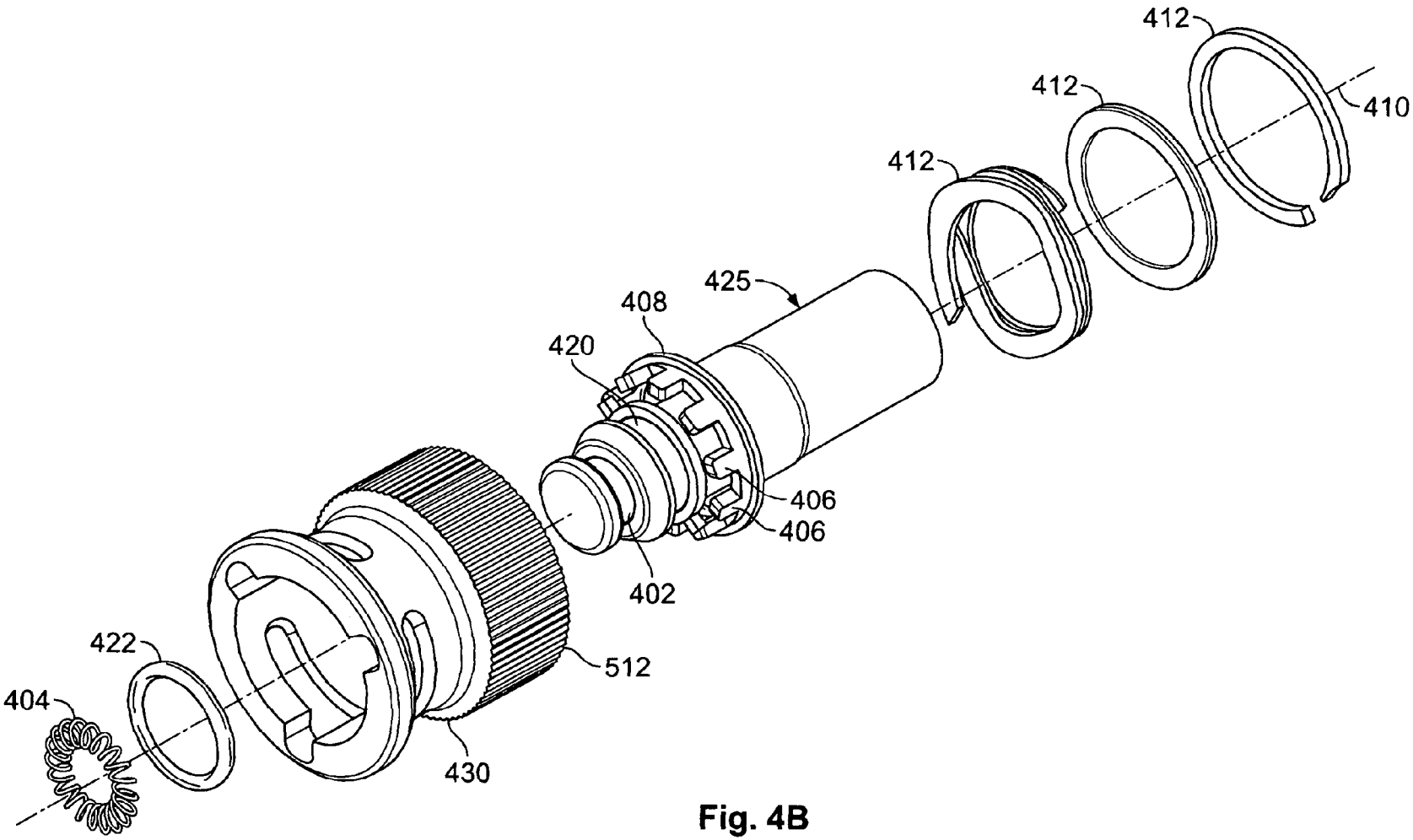
Figure 5:
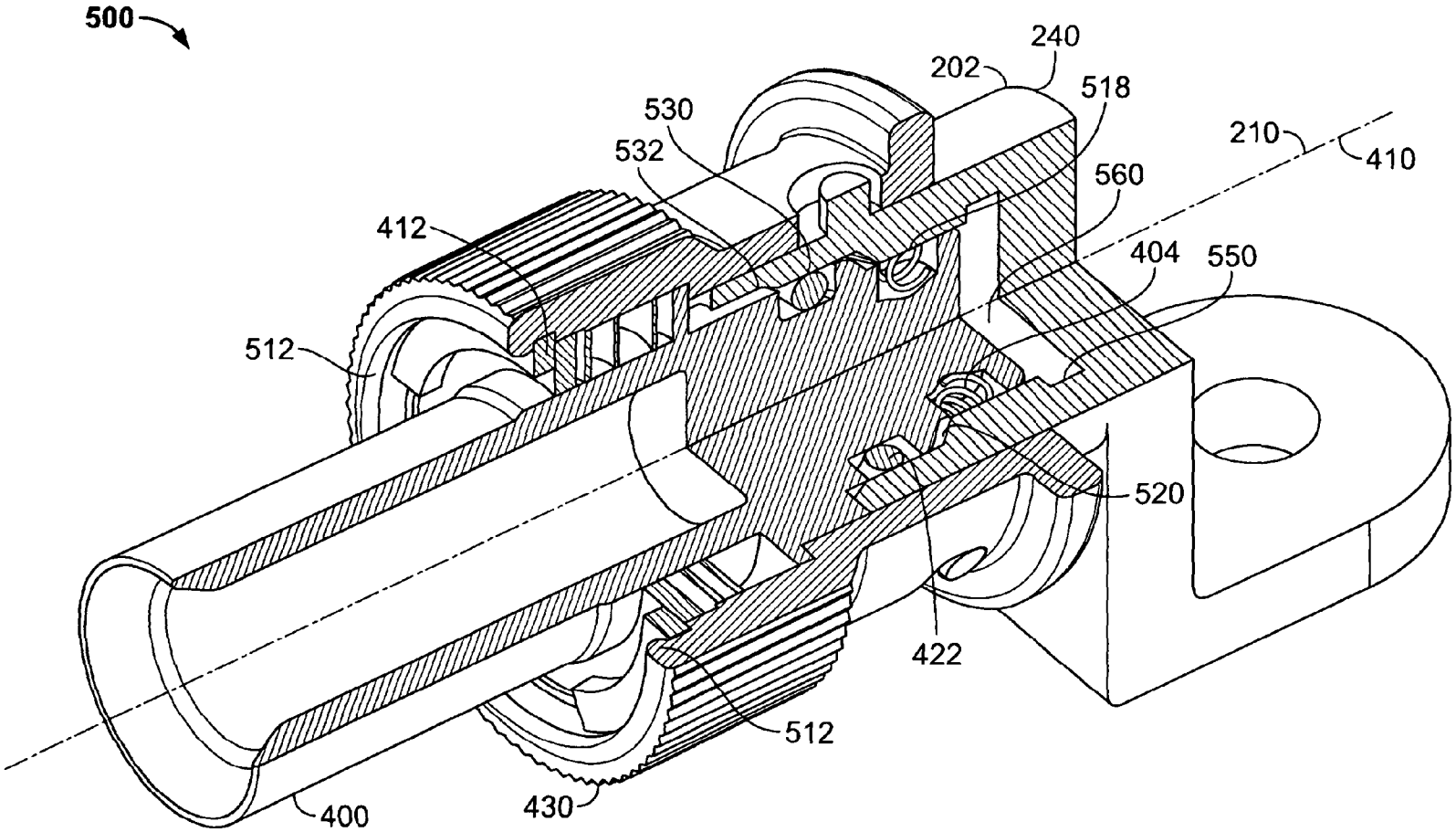

FIG. 4*a* shows a schematic diagram of a connector pin and a rotor suitable for forming a connector system according to an embodiment of the invention when used together with the sockets of FIG. 2 or 3;

FIG. 4*b* shows a schematic diagram of the connector pin of FIG. 4*a* in a disassembled state; and FIG. 5 shows a schematic diagram of a connector system according to an embodiment of the invention and including the socket of FIG. 2 and the connector pin and rotor of FIG. 4*a*.

Figure 1:
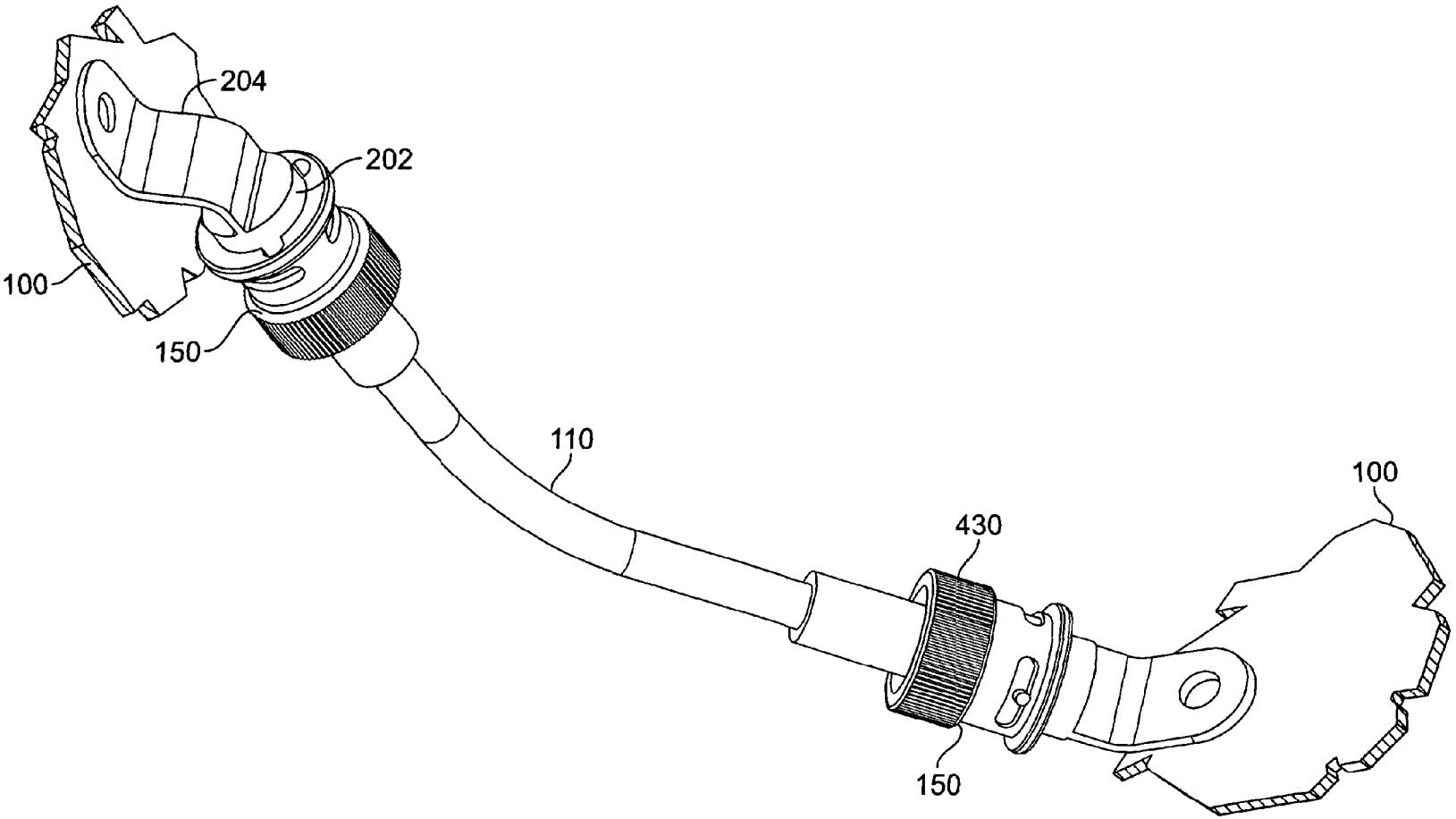
FIG. 1 shows a schematic diagram of an electrical connection comprising two connectors systems according to an embodiment of the invention.

The electrical connection shown in FIG. 1 comprises two electrodes 100 and an electrical cable 110, the two electrodes 100 being connected together via the electrical cable 110 using two connector systems 150. The electrodes 100 may for example be portions of respective aircraft raceways, the raceways being electrically connected together by the cable 110 and connector systems 150. Each connector system 150 is capable of carrying a current of 100 A whilst presenting an electrical resistance of no more than 0.25 mOhm.

FIG. 2 shows a socket 200 suitable for forming part of the connector systems 150. The socket comprises a cup portion 202 and a fixing portion 204. The cup portion 202 has a set of teeth 206 extending around the axis 210 of the cup portion. The cup portion 202 also has radially protruding knobs 220 for engaging with a rotor (discussed below in relation to FIG. 4*a*).

In this embodiment the cup portion is attached to a fixing portion formed in an L shape, although other shapes of fixing portion are possible, for example the fixing portion shapes used in the sockets of FIG. 3.

In this embodiment, the socket is formed of aluminium, and the teeth 206 are hard anodised to reduce corrosion and/or wear. The hard anodising increases the electrical surface resistance of the teeth, although this is not a significant problem because the primary function of the teeth is to provide a mechanical connection.

The cup portion 202 and the fixing portion 204 are integrally formed in one piece, although in alternate embodiments may be manufactured separately and joined together.

In this embodiment, the cup portion 202 has a closed end 240, which can help protect the inside of the cup from external environmental conditions. In an alternate embodiment, the cup portion is formed with an open end to help reduce weight.

FIG. 4*a* shows a contact pin 400 that is provided with a rotor 430, the rotor 430 having apertures 440 and cutaways 450. An exploded view of the contact pin 400 and rotor 430 in a disassembled state is shown in FIG. 4*b*. The contact pin 400 comprises a coiled spring 404 for fitting in a first groove 402, and O-ring 422 for fitting in a second groove 420, and a compressible washer 412 made up of three separate washer components. The compressible washer 412 slides over the contact pin shaft 425 and rests against the ridge 408, the ridge 408 extending around the axis 410 of the contact pin.

The contact pin further comprises a set of teeth 406 that extend around the axis 410 of the contact pin, and which are for engaging with the teeth 206 of the cup portion of the socket. In this embodiment the teeth 406 and 206 are square shaped which may help reduce any tendency for the teeth to cam apart from one another under rotation of the contact pin relative to the socket, although in alternate embodiments other shaped teeth such as triangular shaped teeth could be used. The contact pin shaft 425 is made of copper and is integrally formed with the teeth 406, the teeth being silver over nickel to improve their resistance to wear and/or corrosion. The groove 402 is conductively plated to improve conduction of current between it and the coiled spring 404. Alternately, the contact pin shaft may be made from other materials and the groove and/or teeth may or may not be hard anodised or conductively plated.

Advantageously, in this embodiment the teeth 406 are formed within the ridge 406, which may help reduce weight. Alternately, the teeth 406 and the ridge may be formed separately from one another at two different axial locations along the shaft 425.

The coiled spring 404 helps to prove a low resistance electrical connection between the cup portion 202 of the socket 200 and the contact pin 400. The coiled spring may be silver plated to help improve the electrical properties of the spring and guard against corrosion, and may for example be a silver plated beryllium copper canted coil spring.

In this embodiment, the compressible washer 412 is formed of three separate washers, although in other embodiments a single washer, for example a wave washer, may be used to help reduce weight.

The contact pin 400 is provided with a rotor 430 to help secure the contact pin 400 to the cup portion 202 of the socket 200, although in other embodiments the coiled spring itself is sufficient to prevent withdrawal of the contact pin from the socket, or the contact pin is provided with an alternate means for preventing unintentional withdrawal of the pin from the socket. As can be seen in FIG. 4*a*, the rotor 430 extends axially over the coiled spring 404 which may help protect the coiled spring from damage before the contact pin is inserted into the cup portion 202.

The rotor 430 has a ridge 512 (shown in FIG. 5) inside the rotor extending around the axis of the rotor. The compressible washer 412 is compressible between the ridge 408 of the contact pin shaft and the ridge 512 of the rotor when the contact pin and the rotor are fitted together as shown in FIG. 4*a*.

The rotor 430 has apertures 440 for receiving the radially protruding knobs 220 of the socket cup portion 202. Upon insertion of the contact pin 400 into the cup portion 202 the knobs 220 are received into the apertures 440, and then the rotor may be rotated around the contact pin 400 and the cup portion 202 causing the knobs 220 to slide along the cutaways 450 of the rotor. The cutaways 450 may include bulbous ends in which the knobs 220 can settle once the rotor has been fully rotated, and the cutaways may be aligned non-orthogonally to axis 410 to help push the contact pin shaft 425 into the cup portion 202 as the rotor 430 is rotated.

FIG. 5 shows a schematic diagram of the socket 200 when engaged with the contact pin 400 and rotor 430. The contact spring shaft 425 is within the cup portion 202 and the coiled spring 404 contacts a first contact surface 518 inside the cup portion and extending around the axis 210 of the cup portion. Furthermore, the O-ring 422 is also within the cup portion 202 and contacts a second contact surface 530 inside the cup portion and extending around the axis 210 of the cup portion. The first contact surface 518 is conductively plated to help reduce the electrical resistance between the coiled spring 404 and the cup portion 202.

The cup portion 202 comprises a first ramp portion 520 inside the cup portion, the first ramp portion reducing the internal width of the cup portion to where the first contact portion 518 is located. During insertion of the contact pin 400 into the cup portion 202, the first ramp portion acts to compress the coiled spring 404 such that the coiled spring comes to rest against the first contact portion 518 in a compressed state, helping improve the electrical connection between the coiled spring 404 and the cup portion 202.

The cup portion 202 further comprises a second ramp portion 532 inside the cup portion, the second ramp portion reducing the internal width of the cup portion to where the second contact portion 530 is located. During insertion of the contact pin 400 into the cup portion 202, the second ramp portion acts to compress the O-ring 422 such that the O-ring comes to rest against the second contact portion 530 in a compressed state. The O-ring creates a seal between the contact pin shaft 425 and the inside of the cup portion 202, helping prevent ingress of debris that could interfere with the electrical connection made by the coiled spring 404.

The first ramp portion 520 adjoins the first contact portion 518 at an obtuse angle of 150 degrees, and the coil spring 404 is no further beyond the first ramp portion 520 than a minimum amount required for the coil spring 404 to safely rest against the first contact portion 518 instead of the first ramp portion 520. Further embodiments use obtuse angles other than 150 degrees.

The second ramp portion 532 adjoins the first contact portion 530 at an obtuse angle of 150 degrees, and the O-ring 422 is no further beyond the second ramp portion 532 than a minimum amount required for the O-ring 422 to safely rest against the second contact portion 530 instead of the second ramp portion 532. Further embodiments use obtuse angles other than 150 degrees.

Placing the second ramp portion 532 and second contact portion 530 such that the O-ring just comes to rest on the second contact portion instead of the second ramp portion when the contact pin is fully inserted, helps minimise the amount of air that becomes trapped in the cavity 560 between the end of the contact pin shaft and the closed end of the cup portion 202. If the O-ring continues to be slid further than just beyond the obtuse angle, the air pressure within the cavity 560 will increase.

The pressure differential between the air inside and outside the cavity 560 can result in a significant force attempting to drive the contact pin out of the cup portion, for example if the outside pressure is low as may be encountered in aerospace applications.

The increase of air pressure within the cavity 560 during insertion of the contact pin 400 into the cup portion 202 may be reduced by increasing the volume of the cavity 560. Advantageously, the cup portion 202 comprises an undercut 550 into the walls of the cup portion 202 at the closed end 240 of the cup portion, thereby increasing the volume of the cavity 560 and reducing the tendency of trapped air in the cavity 560 to exert an ejecting force on the contact pin. The contact pin 400 and cup portion 202 are configured such that a cavity 560 having a length of at least 1.8 mm along the axis 210 of the cup portion is present between the end of the contact pin 400 and the end of the cup portion 202 after insertion of the contact pin into the cup portion.

The compressible washer 412 exerts a continuous force on the contact pin shaft 425, urging the contact pin shaft into the cup portion and counteracting any increase in air pressure differential within the cavity 560 compared to the outside environment. The continual force exerted by the compressible rings helps prevent any longitudinal vibration of the contact pin shaft relative to the cup portion.

The cup portion 202 has a circular cross section, although in other embodiments the cross section may be other shapes, for example oval or triangular. The use of a circular cross section (with corresponding circularly arranged teeth) may help in restricting relative movement between the socket and the contact pin. Additionally, the circular cross section means that the contact pin can be inserted into the socket at almost any rotational angle (provided the teeth mesh).

The scope of the invention is defined by the appended independent claim(s). Further features appearing in dependent claims are optional and may or may not be implemented in various embodiments of the invention which will be apparent to those skilled in the art.

The invention claimed is:

1. A connector system comprising a contact pin and a socket for receiving the contact pin, the contact pin comprising:

a first groove extending around the axis of the contact pin;

a coiled spring within the first groove;

a set of teeth extending around the axis of the contact pin;

wherein the socket comprises a cup portion, the cup portion comprising:

a set of teeth extending around the axis of the cup portion and for engaging with the teeth of the contact pin;

a first contact surface inside the cup portion and extending around the axis of the cup portion for contacting the coiled spring of the contact pin;

a first ramp portion inside the cup portion, the first ramp portion reducing the internal width of the cup portion to where the first contact surface is located, the first ramp portion arranged to compress the coiled spring on insertion of the contact pin into the cup portion so that the coiled spring comes to rest against the first contact surface in a compressed state.

2. The connector system of claim 1, wherein the cup portion comprises radially protruding knobs, wherein the connector system further comprises a rotor mounted around the contact pin, the rotor comprising apertures and cutaways, the apertures leading into the cutaways, the radially protruding knobs of the cup portion arranged to be received in the apertures upon insertion of the contact pin into the cup portion, and then slid along the cutaways upon rotation of the rotor around the contact pin and the cup portion.

3. The connector system of claim 2, wherein the contact pin further comprises a ridge extending around the axis of the contact pin, and a compressible washer abutting the ridge, and wherein the rotor comprises a ridge inside the rotor for engaging the compressible washer, the compressible washer urging the contact pin into the cup portion when the rotor is rotated around the contact pin and the cup portion.

4. The connector system of claim 3, wherein the compressible washer is a wave washer.

5. The connector system of claim 3, wherein the teeth of the contact pin are formed in the ridge of the contact pin.

6. The connector system of claim 2, wherein the rotor axially extends over the first groove and the coiled spring of the contact pin.

7. The connector system of claim 1, wherein the first ramp portion adjoins the first contact portion at an obtuse angle, and wherein the first ramp portion and first contact portion are positioned in the cup portion so that upon insertion of the contact pin into the cup portion the coil spring moves no further beyond the first ramp portion than a minimum amount required for the coil spring to safely rest against the first contact portion instead of the first ramp portion.

8. The connector system of claim 1, wherein the contact pin further comprises a second groove extending around the axis of the contact pin, and an O-ring within the second groove, and wherein the cup portion further comprises a second contact surface inside the cup portion and extending around the axis of the cup portion for contacting the O-ring of the contact pin.

9. The connector system of claim 8, wherein the cup portion comprises a second ramp portion inside the cup portion, the second ramp portion reducing the internal width of the cup portion to where the second contact portion is located, the second ramp portion arranged to compress the O-ring on insertion of the contact pin into the cup portion.

10. The connector system of claim 9, wherein the second ramp portion adjoins the second contact portion at an obtuse angle, and wherein the second ramp portion and second contact portion are positioned in the cup portion so that upon insertion of the contact pin into the cup portion the O-ring moves no further beyond the second ramp portion than a minimum amount required for the O-ring to safely rest against the second contact portion rather than the second ramp portion.

11. The connector system of claim 8, wherein the first groove is located further toward a closed end of the cup portion than the second groove when the contact pin is inserted into the cup portion.

12. The connector system of claim 1, wherein the cup portion comprises an undercut into the walls of the cup portion at a closed end of the cup portion.

13. The connector system of claim 1, wherein the socket further comprises a fixing portion for electrically and mechanically connecting the cup portion to an electrode.

14. The connector system of claim 13, wherein the cup portion and the fixing portion are integrally formed in one piece.

15. The connector system of claim 1, wherein the teeth of the cup portion are hard anodised, and wherein the first contact surface of the cup portion is conductively plated.

16. The connector system of claim 1, wherein the connector system is capable of carrying a current of 100 A whilst presenting an electrical resistance of no more than 0.25 mOhm.

17. The connector system of claim 1, wherein the contact pin and cup portion are configured such that a cavity having a length of at least 1.8 mm along the axis of the cup portion is present between the end of the contact pin and the end of the cup portion after insertion of the contact pin into the cup portion.

* * * * *